US007287677B2

(12) United States Patent
Reid

(10) Patent No.: US 7,287,677 B2
(45) Date of Patent: Oct. 30, 2007

(54) BACKPACK SUSPENSION SYSTEM

(75) Inventor: Lawrence Carter Reid, Gibsons (CA)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 11/019,220

(22) Filed: Dec. 23, 2004

(65) Prior Publication Data

US 2006/0011689 A1 Jan. 19, 2006

Related U.S. Application Data

(63) Continuation of application No. 10/798,561, filed on Mar. 12, 2004, now abandoned.

(60) Provisional application No. 60/454,356, filed on Mar. 14, 2003.

(51) Int. Cl.
*A45F 3/04* (2006.01)

(52) U.S. Cl. ..... 224/637; 224/641; 224/631; 224/628; 224/636; 224/634

(58) Field of Classification Search ..... 224/628, 224/631, 634, 637, 641, 636
See application file for complete search history.

(56) References Cited

U.S. PATENT DOCUMENTS

| | | | | |
|---|---|---|---|---|
| 204,066 A | | 5/1878 | Merriam | |
| 1,723,147 A | | 8/1929 | Fourethier | |
| 3,923,216 A | | 12/1975 | Farnbach | 224/8 R |
| 4,015,759 A | * | 4/1977 | Dreissigacker et al. | 224/262 |
| 4,018,370 A | | 4/1977 | Wood | 224/25 A |
| 4,133,464 A | | 1/1979 | Kelty | 224/25 A |
| 4,189,076 A | | 2/1980 | Zufich | 224/211 |
| 4,194,656 A | | 3/1980 | Zufich | 224/211 |
| 4,214,685 A | | 7/1980 | Pletz | 224/211 |
| 4,217,998 A | | 8/1980 | Alexander | 224/261 |
| 4,303,186 A | * | 12/1981 | Ollinger, IV | 224/634 |
| 4,327,851 A | * | 5/1982 | Feathers | 224/634 |
| 4,369,903 A | | 1/1983 | Wilkes | 224/213 |

(Continued)

FOREIGN PATENT DOCUMENTS

CA 797075 10/1968

(Continued)

OTHER PUBLICATIONS

Declaration of Lawrence Carter Reid Under 37 C.F.R. §§ 1.97 and 1.98, dated Sep. 2, 2005.

(Continued)

*Primary Examiner*—Nathan J. Newhouse
*Assistant Examiner*—Lester L. Vanterpool
(74) *Attorney, Agent, or Firm*—Steptoe & Johnson LLP

(57) ABSTRACT

A suspension system for a backpack includes a rocker arm pivotally connected to the backpack. A first hip stay has a first end connected to a first end of the rocker arm and a second end opposite the first end. A second hip stay has a first end connected to a second end of the rocker arm and a second end opposite the first end. A waist belt is attached to the second end of the first hip stay and to the second end of the second hip stay. The first and second hip stays distribute the load of the backpack between a wearer's left and right hips. A backpack incorporating the suspension system is also disclosed.

37 Claims, 6 Drawing Sheets

U.S. PATENT DOCUMENTS

| | | | | |
|---|---|---|---|---|
| 4,489,866 | A | 12/1984 | Korte | 224/155 |
| 4,504,002 | A | 3/1985 | Hall | 224/211 |
| 4,676,418 | A | 6/1987 | Lowe | 224/215 |
| 4,827,578 | A | 5/1989 | Heckerman et al. | 24/265 A |
| 4,844,307 | A | 7/1989 | Rutledge | 224/211 |
| 4,976,387 | A | 12/1990 | Spianti | 224/262 |
| 5,090,604 | A | 2/1992 | Howe | 224/211 |
| 5,503,314 | A * | 4/1996 | Fiscus | 224/665 |
| 5,954,250 | A * | 9/1999 | Hall et al. | 224/262 |
| 5,954,253 | A * | 9/1999 | Swetish | 224/631 |
| 6,276,584 | B1 * | 8/2001 | McLachlan | 224/637 |
| 6,637,631 | B2 * | 10/2003 | Lafoux et al. | 224/197 |
| 2005/0092802 | A1 * | 5/2005 | Maley | 224/628 |

FOREIGN PATENT DOCUMENTS

| | | |
|---|---|---|
| GB | 13605 | 0/1908 |
| GB | 450658 | 7/1936 |
| GB | 2 350 286 A | 11/2000 |
| WO | WO 2005/004668 A1 | 1/2005 |

OTHER PUBLICATIONS

"Berghaus C7 Pro Series Pack—First Look", by Jon, dated Jan. 31, 2005, 9 pages, posted on http://www.outdoorsmagic.com.

"Berghaus Bioflex Tested!", by Jon, 6 pages, dated Sep. 30, 2004, posted on www.outdoorsmagic.com.

"Berghaus Bioflex Explained A Bit More . . . ", by Jon, dated Sep. 16, 2004, 5 pages, posted on http://www.outdoorsmagic.com.

"Revolutionary 2005 Berghaus Packs Revealed", by Maria Clegg, dated Sep. 13, 2004, 8 pages, posted on http://www.outdoorsmagic.com.

"Designs on the market. QinetiQ and Berghaus revolutionise load carrying", undated, 2 pages.

"macpac", dated 2004, 12 pages, posted on http://www.macpac.co.nz/customer-support/pack-harnesses/.

* cited by examiner

BACKPACK SUSPENSION SYSTEM

CROSS-REFERENCE TO RELATED APPLICATION

This application is a continuation of prior application Ser. No. 10/798,561 filed Mar. 12, 2004 now abandoned, which in turn claims the benefit of Provisional Application No. 60/454,356 filed Mar. 14, 2003 under 35 U.S.C. § 119(e). The entire contents of these applications are expressly incorporated herein by reference thereto.

TECHNICAL FIELD OF THE INVENTION

The present invention relates generally to backpacks and other load carrying systems. More specifically, the present invention relates to backpacks and load carrying systems that dynamically distribute the load to a wearer's body.

BACKGROUND OF THE INVENTION

Backpacks are commonly used in recreational activities, such as hiking, climbing and skiing, to carry clothing, food, water, shelter, equipment and various other items. Backpacks are also used in everyday activities to carry items such as books, files and computers. Conventional backpacks typically employ a shoulder harness that extends over one or both of the wearer's shoulders in conjunction with a waist belt that wraps around the wearer's waist. The shoulder harness and waist belt allow the load of the backpack (and its contents) to be distributed over both the wearer's shoulders and waist.

Various movements of the backpack wearer may cause the load of the backpack to undesirably shift to one side of the body or the other. For example, rocking of the wearer's hips during walking or hiking (as a result of the wearer's natural gait) may cause the backpack and/or the load to shift with respect to the wearer's body, undesirably emphasizing the load on one of the hips, and/or on one or both of the shoulders. This shifting is often emphasized in situations where the wearer is traveling uphill, downhill, or across off-camber, rough and/or uneven terrain.

Numerous backpack suspension systems have been developed to reduce the shifting of the load on the wearer's body. For example, backpacks have been developed with semi-rigid frames that flex along with the wearer's body to reduce the shifting of the load. In addition, backpacks have been developed with pivoting hip belts that pivot to compensate for movement of the wearer's hips relative to the rest of their body. These packs, however, fail to adequately compensate for the shifting of the load. Therefore, there remains a need in the art for a backpack suspension system that evenly distributes the backpack's load over the wearer's body throughout various movements and shifting of the body.

SUMMARY OF THE INVENTION

The present invention is directed to a suspension system for a backpack, including a rocker arm pivotally connected to the backpack, a first hip stay having a first end connected to a first end of the rocker arm and a second end opposite the first end, and a second hip stay having a first end connected to a second end of the rocker arm and a second end opposite the first end. The first end of the first hip stay may be flexibly or substantially rigidly connected to the first end of the rocker arm, and the first end of the second hip stay may be similarly connected to the second end of the rocker arm. A waist belt is attached to the second ends of the first and second hip stays. The load of the backpack and its contents may be dynamically transferred from the backpack to the waist belt through the first and second hip stays. The first end of the first hip stay may be flexibly connected to the first end of the rocker arm by a first resilient member, and the first end of the second hip stay may be flexibly connected to the second end of the rocker arm by a second resilient member. The second ends of the hip stays may attach to the waist belt at points that are substantially adjacent opposite sides of a wearer's hips. As a result, the backpack may present a downward force on the wearer that is concentrated within a central region of the wearer's skeletal frame.

The suspension system may further comprise a mounting plate to which the rocker arm is pivotally connected. A tail stay may extend from the mounting plate to the waist belt intermediate the first hip stay and the second hip stay, and serve to stabilize movement between the backpack and the waist belt.

The backpack may include a shoulder harness that is spaced a vertical distance from the waist belt, wherein the first and second hip stays allow the vertical distance between the shoulder harness and the waist belt to increase or decrease to compensate for changes in length of the wearer's spine during bending movements.

The present invention is also directed to a backpack incorporating the suspension system.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
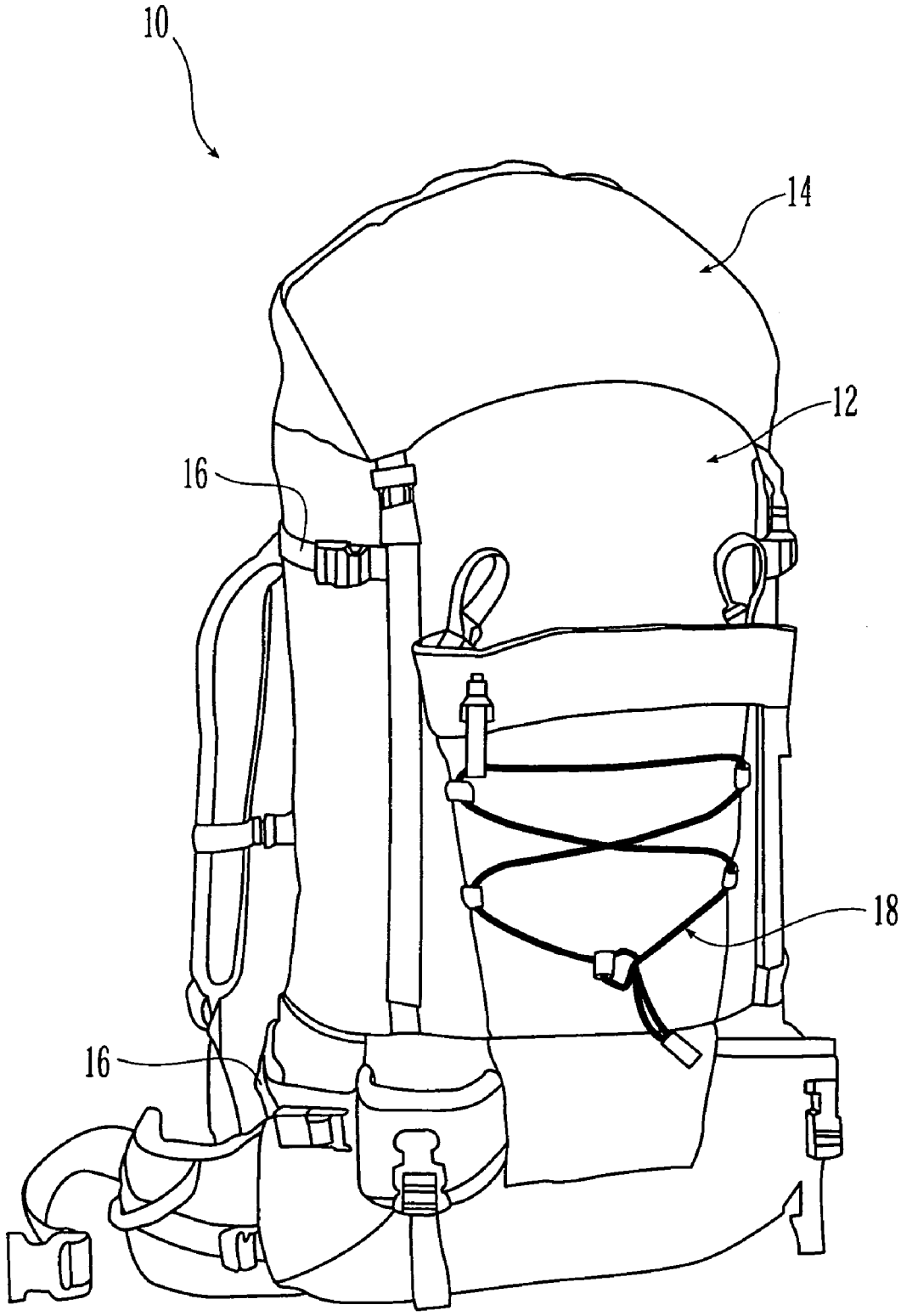
FIG. 1 is a perspective view of one illustrative embodiment of a backpack incorporating a suspension system according to the present invention.

Referring to FIG. 1, an illustrative embodiment of a backpack incorporating a suspension system according to the present invention is shown. Backpack 10 generally includes a pack bag 12 for storing items to be carried, and a lid 14 removably attached to the pack bag 12 to provide access to the interior of the pack bag 12. Backpack 10 may also include various other straps and accessories, such as compression straps 16 and/or a bungee cord 18. It should be noted, however, that the principles of the present invention are not limited to any specific type of backpack construction, and that the suspension system of the present invention may be used with backpacks or other load carrying devices having any shape, size or configuration known to one of ordinary skill in the art. For example, backpack 10 may have a zippered opening instead of the removable lid 14 shown in FIG. 1.

Figure 2:
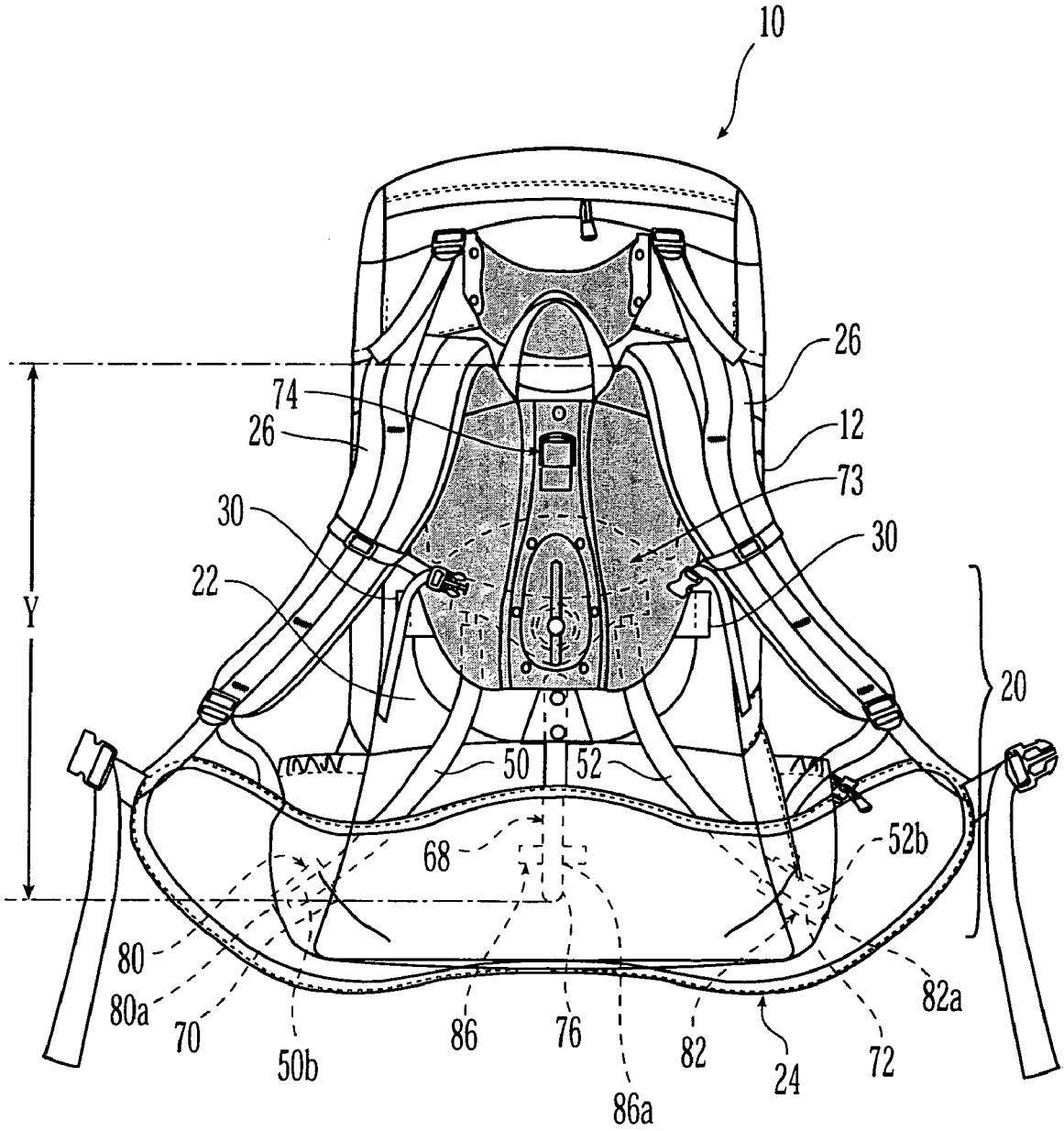
FIG. 2 is an elevational view of the back portion of the backpack of FIG. 1, with portions of the suspension system shown in hidden lines.

As shown in FIG. 2, the suspension system 20 is associated with the rear wall 22 of backpack 10, and connects a waist belt 24 to the pack bag 12. The waist belt 24 is shaped and configured to be worn around a wearer's waist, and supports all or a portion of the load of the backpack 10 (and its contents) on the wearer's body. Waist belts of many different shapes, materials and constructions are known in the art, and the suspension system of the present invention is not limited to use with any specific type of waist belt.

As also shown in FIG. 2, backpack 10 may include one or more adjustable shoulder straps 26 (or a harness system) that, if provided, work in conjunction with the waist belt 24 to support the load of the back pack 10 (and its contents) on the wearer's body. The shoulder strap(s) 26 may extend from an upper region of the backpack 10 and loop over a wearer's shoulders and connect with a lower region of the backpack 10. For example, shoulder strap(s) 26 may connect to the upper region of backpack 10 via an adjustable frame sheet 67 (shown in FIG. 6) that is associated with the rear wall 22 of the backpack 10, and connect to the lower region of the backpack 10 via the rear wall 22. Alternatively, the shoulder strap(s) 26 may connect to the upper region of backpack 10 directly via the rear wall 22. One of ordinary skill in the art, however, will know and appreciate that the present invention is not limited to any specific connection between the shoulder strap(s) 26 and the backpack 10. Moreover, many different types of shoulder straps and harness systems are known in the art, and the suspension system of the present invention is not limited to use with any specific type of shoulder strap(s) or harness systems, nor is it limited to use with shoulder strap(s) or a harness system at all.

Figure 3:
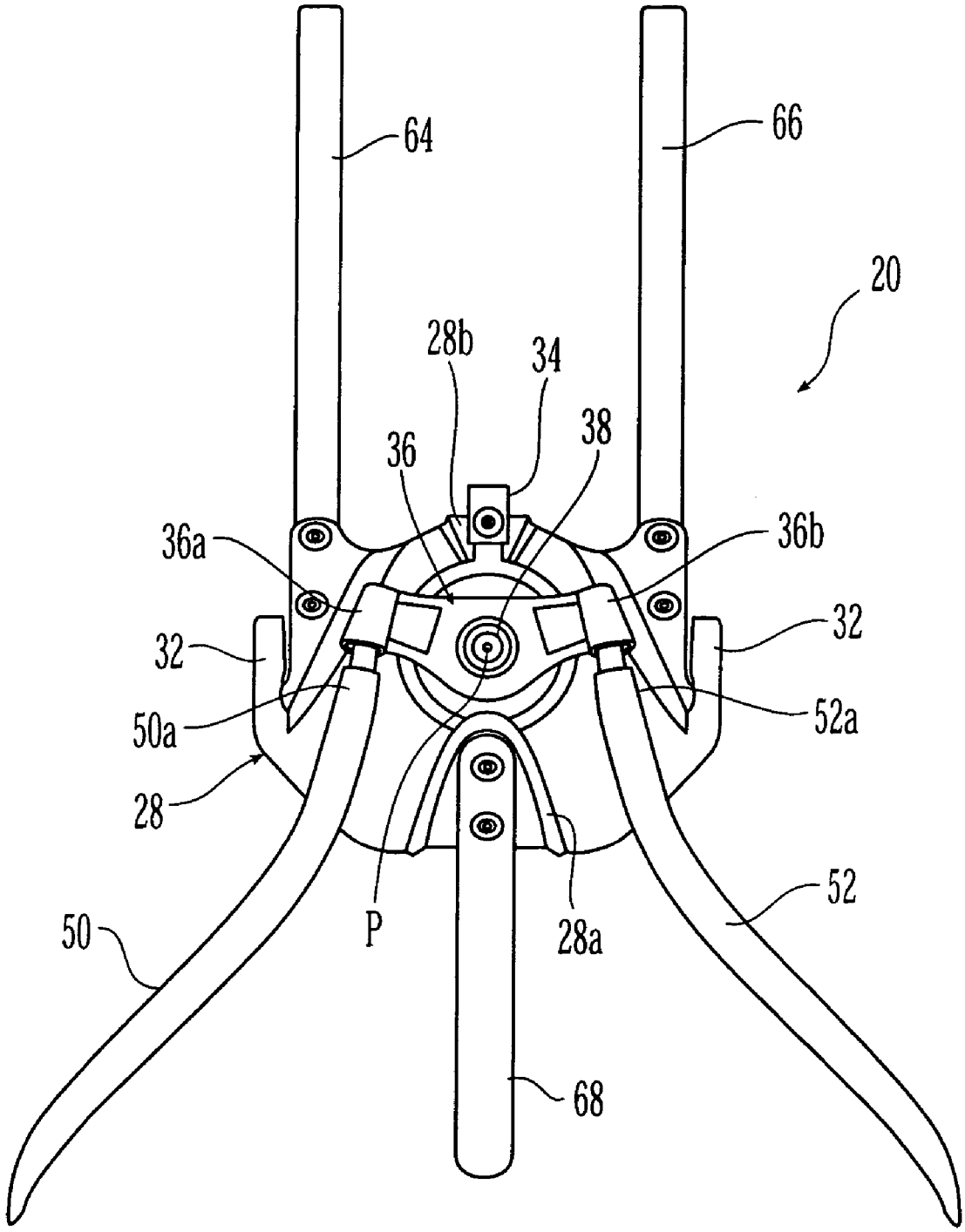
FIG. 3 is an elevational view of the suspension system of FIG. 2, shown removed from the backpack.
Figure 4:
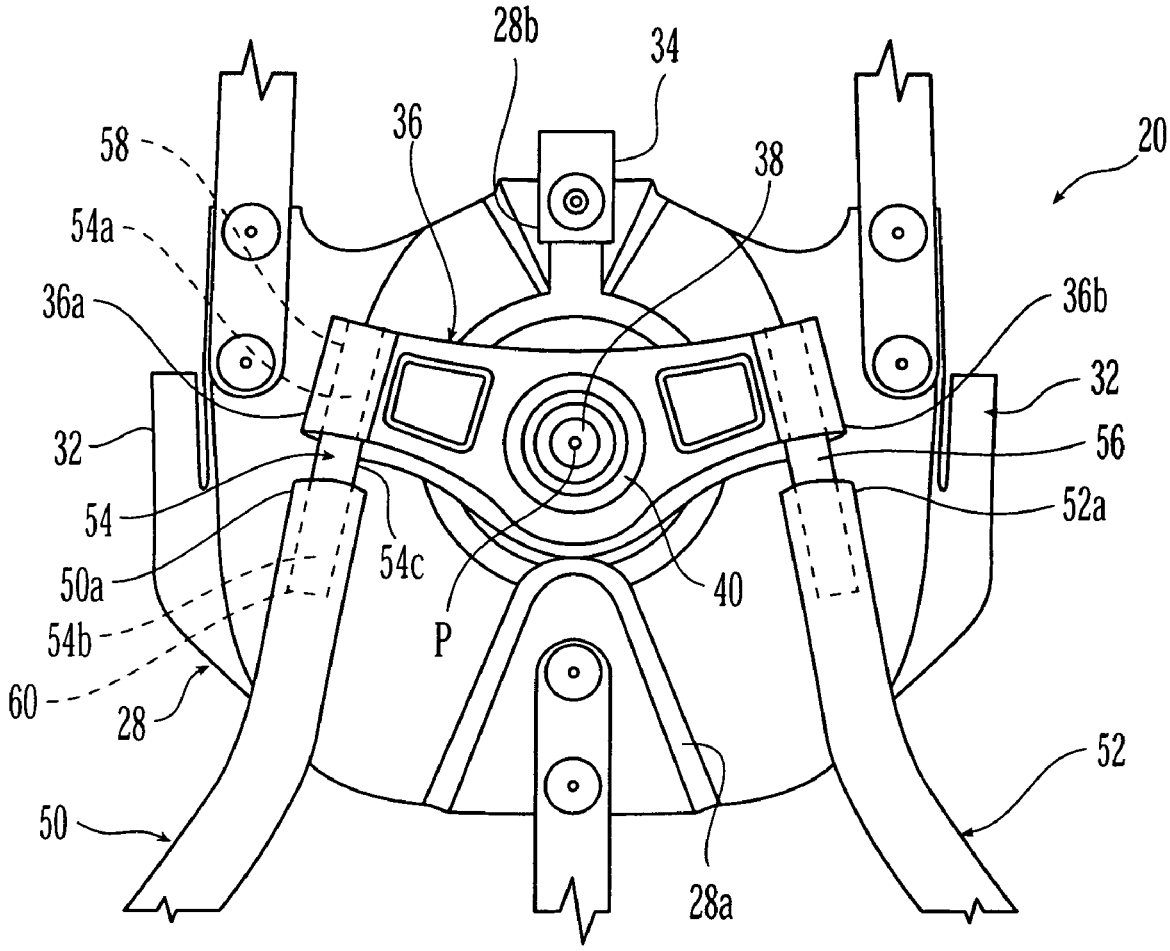
FIG. 4 is an enlarged, partial view of the suspension system of FIG. 3.

Referring to FIGS. 3 and 4, the suspension system 20 includes a mounting plate 28 that is attached to the rear wall 22 of the pack bag 12. Mounting plate 28 may be formed of a rigid or semi-rigid material, such as ABS plastic, polyethylene, nylon, delrin, reinforced thermosets (such as epoxy and fiberglass), aluminum or titanium, however any other suitable material known to one of ordinary skill in the art may be used as well. The mounting plate 28 may be attached to the rear wall 22 of the pack bag 12 by strips of fabric 30 (shown in FIG. 2) which are sewn to the rear wall 22 and extend across tabs 32 formed on mounting plate 28, as well as by a snap connector 34 that attaches to the rear wall 22. Additionally or alternatively, the mounting plate 28 may be attached to the rear wall 22 by riveting, stitching, bonding, stapling, sewing, or any other technique known to one of ordinary skill in the art.

Suspension system 20 also includes a rocker arm 36 that is pivotally connected to the mounting plate 28 and pivots about pivot axis P. A bolt 38 extends through aligned bores in mounting plate 28 and rocker arm 36, along pivot axis P, and results in the pivoting connection between these two parts. Suitable materials for the rocker arm 36 include, for example, nylon, reinforced nylon, polyacetal, sheet molding compounds, bulk molding compounds, composites, and metals.

To smoothen the pivoting action between mounting plate 28 and rocker arm 36, the rocker arm 36 may have a bearing 40 (such as a cartridge-type ball bearing) surrounding the bolt 38, as shown in FIG. 4. Alternatively, a bushing or other member may surround the bolt 38, to provide some resistance to pivoting of rocker arm 36 with respect to mounting plate 28, and to provide a degree of damping to the suspension system 20. Mounting plate 28 may include raised regions, such as raised regions 28*a* and 28*b*, which may engage rocker arm 36 to prevent over-rotation of rocker arm 36.

Still referring to FIGS. 3 and 4, suspension system 20 also includes first and second hip stays 50, 52, each of which have first ends 50*a*, 52*a*, respectively, that are connected to opposite first and second ends 36*a*, 36*b* of rocker arm 36. As shown in FIG. 4, the first end 50*a* of first hip stay 50 may be flexibly connected to the first end 36*a* of rocker arm 36 by a resilient member 54. Similarly, the first end 52*a* of second hip stay 52 may be flexibly connected to the second end 36*b* of rocker arm 36 by a resilient member 56. Suitable materials for resilient members 54, 56 may include, for example, polyurethane or nitrile rubber, or any other resilient materials known to one of ordinary skill in the art. Still referring to FIG. 4, end portion 54*a* of resilient member 54 may be received in a bore 58 located in the first end 36*a* of rocker arm 36, and the other end portion 54*b* may be located in a bore 60 in the first end 50*a* of first hip stay 50, with a central portion 54*c* of resilient member 54 exposed to provide the flexible connection. Resilient member 56 may be attached to the second end 36*b* of rocker arm 36 and the first end 52*a* of second hip stay 52 in the same manner. Co-molding, bonding, press-fitting, pinning, screwing, or other techniques known to one of ordinary skill in the art may be used to secure the resilient members 54, 56 in the respective bores. The flexible connection between the first and second ends 36*a*, 36*b* of rocker arm 36 and the first and second hip stays 50, 52 may alternatively be provided by a ball-and socket joint or a pivoting connection (such as described above with respect to rocker arm 36), however it is preferable that there be some amount of resistance to movement between the hip stays 50, 52 and the ends 36*a*, 36*b* of the rocker arm 36, to prevent the suspension system 20 from being over flexible or collapsing under heavy loads. According to another alternative embodiment, the rocker arm 36 and the first and second hip stays 50, 52 may be formed integrally, with the flexible connections provided by a thinned region in the members, such as is commonly referred to as a "living hinge." According to yet another alternative embodiment, the first ends 50*a*, 52*a* of the first and second hip stays 50, 52 may be substantially rigidly attached to the first and second ends 36*a*, 36*b*, respectively, of the rocker arm 36. This may be achieved, for example, by forming the rocker arm 36 and the first and second hip stays 50, 52 as a monolithic structure, or alternatively, by any method of rigid attachment known to one of ordinary skill in the art.

Figure 6:
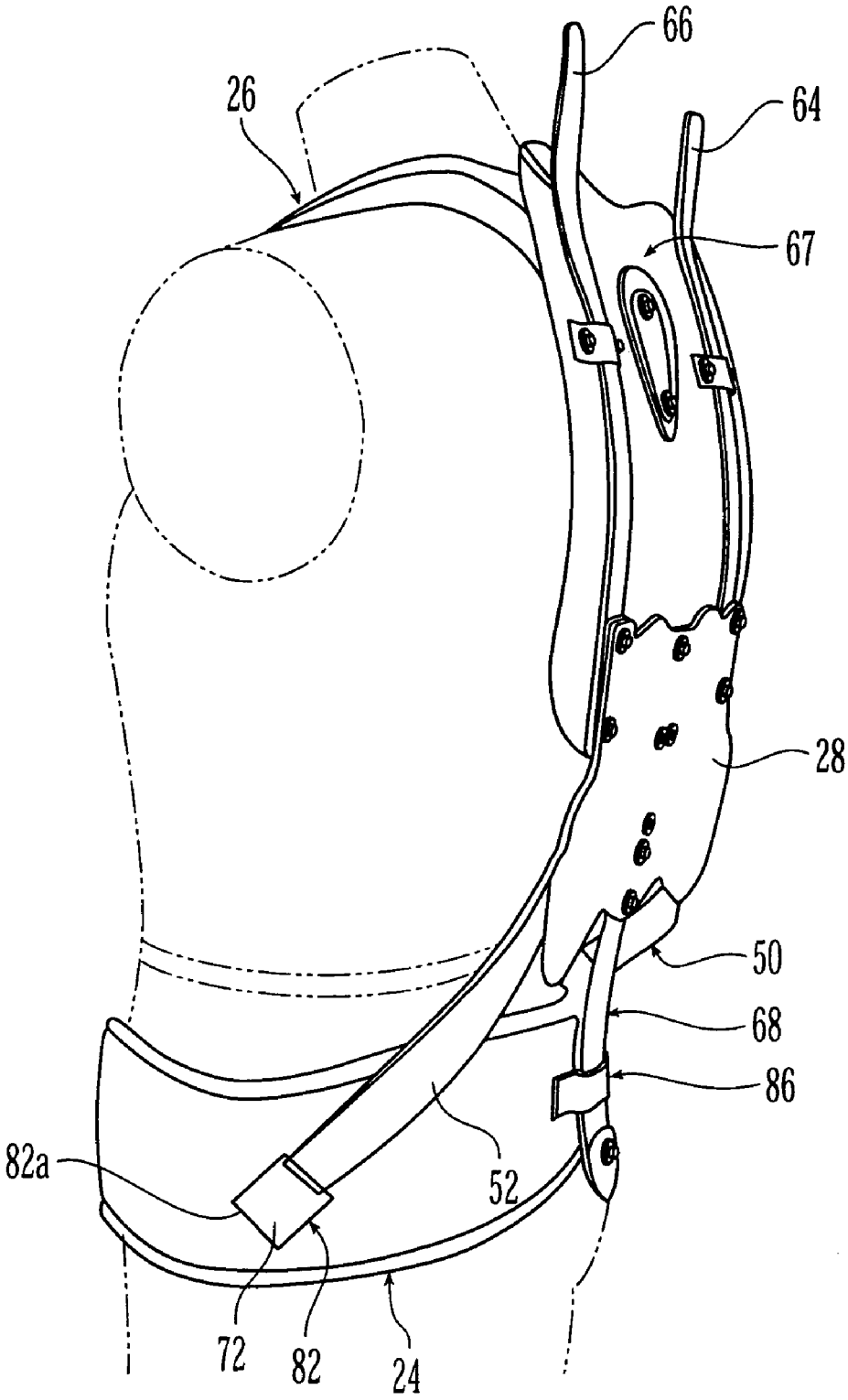
FIG. 6 is a perspective view of the suspension system of the present invention shown being worn by a mannequin.

First and second back stays 64, 66 may be connected to the mounting plate 28, as shown in FIG. 3, and extend upwards along the path of the wearer's back. The first and second back stays 64, 66 act to reinforce and/or stiffen the rear wall 22 of the pack bag 12. A frame sheet 67 of rigid or semi-rigid material (shown in FIG. 6) may be placed over the back stays 64, 66 to further reinforce and/or stiffen the rear wall 22, and/or to prevent objects stored in the pack bag 12 from poking the wearer's back. The frame sheet 67, if provided, may also serve as an anchor point for the optional shoulder straps 26, as shown in FIG. 6. A tail stay 68 may extend downward from the mounting plate 28, as will be discussed in more detail below. The back stays 64, 66 and the tail stay 68 may be connected to the mounting plate 28 by riveting, screwing, stapling, stitching, bonding or other techniques known to one of ordinary skill in the art; alternatively, the back stays 64, 66 and the tail stay 68 may be formed integrally with the mounting plate 28.

Suitable materials for the first and second hip stays 50, 52, back stays 64, 66 and tail stay 68 may include, for example, composites such as fiberglass, carbon fiber or other reinforcing fibers along with epoxies, acrylics and nylons, as well as metals such as aluminum and titanium, although other materials may be used instead.

Referring back to FIG. 2, the second ends 50*b*, 52*b* of the first and second hip stays 50, 52, respectively, are connected to the waist belt 24 at first and second attachment points 70, 72. Attachment points 70, 72 are preferably located substantially adjacent the opposite right and left sides of a wearer's hips when wearing the waist belt 24, thus transferring the load of the backpack (and its contents) to the sides of the wearer's hips, and disbursing it evenly from there. The rocker arm 36 in conjunction with the first and second hip stays 50, 52 provides a suspension between the pack bag 12 and the waist belt 24 through which the load of the pack bag 12 is dynamically transferred to the waist belt 24. This system equally transfers the load to both sides of the body (e.g., to the right and left hips) throughout various movements and shifting of the wearer's body, and prevents the load from being pushed into a position of instability. As a result, the backpack's movements match the wearer's, substantially preventing an undesirable shift of weight from the waist belt 24 to one or more of the shoulder straps 26, and maintains the load on both sides of the wearer's hips regardless of movement. The backpack 10 may also include an optional back pad 73 (shaded gray in FIG. 2) that extends over the mounting plate 28, rocker arm 36 and at least a portion of the first and second hip stays 50, 52 to provide a layer of padding between the wearer's back and the suspension system 20. As shown in FIG. 2, this back pad 73 may be formed integrally with the shoulder straps 26, to form an integral back pad/shoulder harness assembly. If the back pad/shoulder harness assembly is provided, its vertical position on the rear wall 22 of the pack bag 12 may be adjustable, via a buckle 74, to adjust the vertical distance between the shoulder straps 26 and the waist belt 24 to accommodate wearer's having different length torsos.

Still referring to FIG. 2, the end of tail stay 68 is attached to waist belt 24 at a third attachment point 76, which is located intermediate the first and second attachment points 70, 72. The tail stay 68 acts to stabilize movement between the pack bag 12 and the waist belt 24 (e.g., to control or dampen swaying of the pack bag 12 with respect to the waist belt 24 during times of rapid or extreme movements). The tail stay 68 may be a zero force member, meaning that little or none of the load of the backpack (and its contents) is directed from the pack bag 12 to the waist belt 24 through the tail stay 68. This may be accomplished as a result of a slidable connection between the tail stay 68 and the waist belt 24, which will be described in more detail below.

Figure 5:
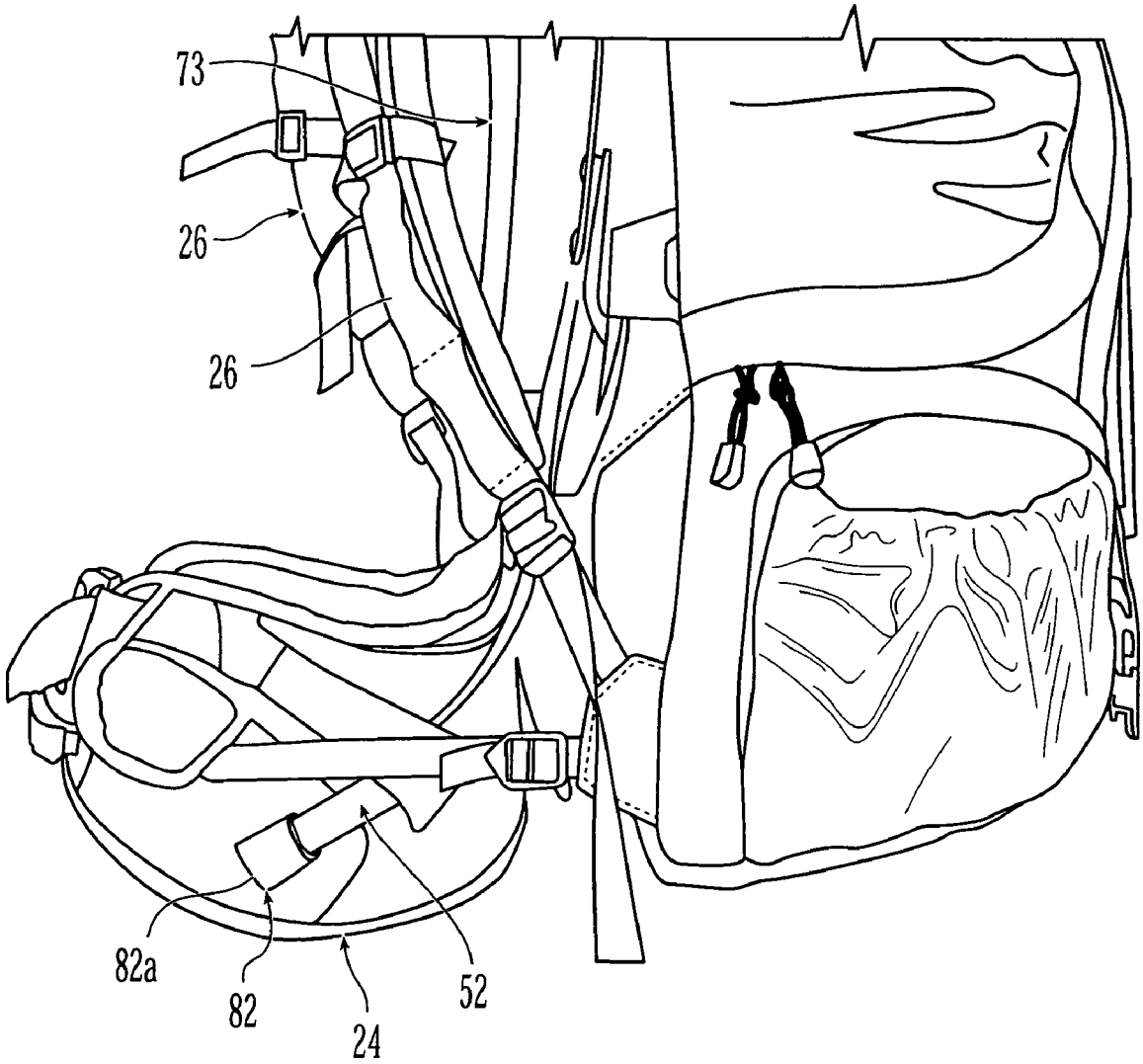
FIG. 5 is a side view of a portion of the backpack of FIG. 1.

Referring to FIGS. 2, 5 and 6, the interface between the first and second hip stays 50, 52 and the waist belt 24 is shown. The second ends 50*b*, 52*b* of the first and second hip stays 50, 52 may be slidably connected to the waist belt 24 at the first and second attachment points 70, 72 respectively, to allow for generally vertical motion between the waist belt 24 and the first and second hip stays 50, 52. For example, as shown in FIGS. 2, 5 and 6, first and second pockets 80, 82 may be formed on the waist belt 24 at the first and second attachment points 70, 72, for slidably receiving the second ends 50*b*, 52*b* of the first and second hip stays 50, 52, respectively. Pockets 80, 82 may be formed by sewing segments of nylon webbing onto the waist belt 24 at the first and second attachment points 70, 72, although the present invention is not limited to any specific construction of pockets 80, 82. First and second pockets 80, 82 may have ends 80*a*, 82*a* closed (e.g., by stitches) to prevent the second ends 50*b*, 52*b* of the first and second hip stays 50, 52 from sliding therethrough, or alternatively, ends 80*a*, 82*a* may be open to allow the second ends 50*b*, 52*b* of the first and second hip stays 50, 52 to slide therethrough. As shown in FIGS. 2 and 6, tail stay 68 may be similarly attached to the waist belt 24 at third attachment point 76 by a third pocket 86 (constructed in the same or a similar manner as the first and second pockets 80, 82, described above). It is preferable that the end 86*a* of third pocket 86 is open sufficiently to allow the tail stay 68 to freely slide therethrough, so that little or none of the load of the backpack is directed from the pack bag 12 to the waist belt 24 through the tail stay 68.

The slidable connection of the first and second hip stays 50, 52 and the tail stay 68 with the waist belt 24 allows the backpack to increase or decrease in length to accommodate the effective lengthening of the spine (and torso) that occurs during bending movements (e.g., the effective length of the wearer's spine increases as the wearer bends over forward). That is, the first and second hip stays 50, 52 and the tail stay 68 can slide with respect to the pockets 80, 82, 86 to allow the vertical distance Y (represented in FIG. 2) from a predetermined point on the shoulder straps 26 to a predetermined point on the waist belt 24 to vary to accommodate changes in the effective length of the wearer's spine. This helps to eliminate riding up of the waist belt 24 on the wearer's hips during bending movements, as is common with conventional backpack designs.

Referring to FIGS. 5 and 6, the hip stays 50, 52 may curve forward towards the front of the wearer such that the first and second attachment points 70, 72 (where the hip stays 50, 52 attach to the waist belt 24) are substantially adjacent the sides of the wearer's hips. This causes the downward force or load of the backpack 10 to be applied to the wearer at the sides of his or her hips, resulting in the downward force or load being concentrated on the central region of the wearer's skeletal frame (e.g., toward the center of a circle defining the wearer's waist) as opposed to being concentrated at a point offset to the back of the wearer's torso, which would result in a moment that is off-center to the skeleton.

While the foregoing description and drawings represent the preferred embodiments of the present invention, it will be understood that various additions, modifications and substitutions may be made without departing from the spirit and scope of the present invention as defined in the accompanying claims. The presently disclosed embodiments are therefore to be considered in all respects as illustrative and not restrictive, the scope of the invention being indicated by the appended claims, and not limited to the foregoing description.

What is claimed is:

1. A suspension system for a backpack, comprising:

a rocker arm pivotally connected to the backpack, the rocker arm having a first end and a second end;

a first hip stay having a first end connected to the first end of the rocker arm and a second end opposite the first end;

a second hip stay having a first end connected to the second end of the rocker arm and a second end opposite the first end; and a waist belt attached to the second end of the first hip stay and to the second end of the second hip stay;

wherein the first and second hip stays are each independently connected to the rocker arm;

wherein the rocker arm pivots about a fixed pivot point;

wherein the waist belt is slidably movable with respect to the hip stays; and wherein the first end of the first hip stay is flexibly connected to the first end of the rocker arm, and the first end of the second hip stay is flexibly connected to the second end of the rocker arm.

2. The suspension system of claim 1, wherein the first end of the first hip stay is flexibly connected to the first end of the rocker arm by a first resilient member, and the first end of the second hip stay is flexibly connected to the second end of the rocker arm by a second resilient member.

3. A suspension system for a backpack, comprising:

a rocker arm pivotally connected to the backpack, the rocker arm having a first end and a second end;

a first hip stay having a first end connected to the first end of the rocker arm and a second end opposite the first end;

a second hip stay having a first end connected to the second end of the rocker arm and a second end opposite the first end; and a waist belt attached to the second end of the first hip stay and to the second end of the second hip stay;

wherein the first and second hip stays are each independently connected to the rocker arm;

wherein the rocker arm pivots about a fixed pivot point;

wherein the waist belt is slidably movable with respect to the hip stays; and wherein the first end of the first hip stay is substantially rigidly connected to the first end of the rocker arm by coupling with a first bore therein, and the first end of the second hip stay is substantially rigidly connected to the second end of the rocker arm by coupling with a second bore therein, with the first and second bores being spaced from the fixed pivot point.

4. The suspension system of claim 1, wherein:

the second end of the first hip stay is attached to the waist belt at a first point; and the second end of the second hip stay is attached to the waist belt at a second point;

wherein the first and second points are substantially adjacent opposite sides of a wearer's hips.

5. The suspension system of claim 4, wherein when the backpack presents a downward force, the first and second hip stays concentrate the downward force within a central region of a wearer's skeletal frame.

6. The suspension system of claim 1, further comprising a mounting plate, wherein the rocker arm is pivotally connected to the mounting plate.

7. A suspension system for a backpack, comprising:

a rocker arm pivotally connected to the backpack, the rocker arm having a first end and a second end;

a first hip stay having a first end connected to the first end of the rocker arm and a second end opposite the first end;

a second hip stay having a first end connected to the second end of the rocker arm and a second end opposite the first end;

a waist belt attached to the second end of the first hip stay and to the second end of the second hip stay;

a mounting plate; and a tail stay extending from the mounting plate to the waist belt intermediate the first hip stay and the second hip stay, wherein the tail stay is disposed to stabilize movement between a pack bag and the waist belt;

wherein the rocker arm is pivotally connected to the mounting plate;

wherein the rocker arm pivots about a fixed pivot point; and wherein the waist belt is slidably movable with respect to the hip stays.

8. The suspension system of claim 7, wherein the tail stay is substantially a zero-force member.

9. The suspension system of claim 7, further comprising a shoulder harness associated with the backpack and spaced a vertical distance from the waist belt, wherein the tail stay is slidably attached to the waist belt to allow the vertical distance between the shoulder harness and the waist belt to increase or decrease to compensate for changes in effective length of a wearer's spine during bending movements.

10. The suspension system of claim 1, wherein a load is dynamically transferred from the backpack to the waist belt through the first and second hip stays.

11. The suspension system of claim 1, wherein the rocker arm is pivotable about a pivot point located intermediate the first and second ends of the rocker arm.

12. A suspension system for a backpack, comprising:

a mounting plate;

a first hip stay having a first end connected to the mounting plate and a second end opposite the first end;

a second hip stay having a first end connected to the mounting plate and a second end opposite the first end; and a waist belt slidably attached to the second end of the first hip stay at a first point, and slidably attached to the second end of the second hip stay at a second point;

wherein the first and second hip stays are contoured such that the first and second points are substantially adjacent sides of a wearer's hips;

wherein the first and second hip stays are movable with respect to a central fixed point on the mounting plate; and wherein the hips stays are permitted to move with respect to the waist belt.

13. The suspension system of claim 12, wherein the first and second hip stays concentrate a downward force of the backpack within a central region of a wearer's skeletal frame.

14. The suspension system of claim 12, further comprising a rocker arm pivotally connected to the mounting plate and having first and second ends, wherein the first end of the first hip stay is connected to the first end of the rocker arm and the first end of the second hip stay is connected to the second end of the rocker arm.

15. The suspension system of claim 14, wherein the first end of the first hip stay is flexibly connected to the first end of the rocker arm, and the first end of the second hip stay is flexibly connected to the second end of the rocker arm.

16. The suspension system of claim 14, wherein the first end of the first hip stay is substantially rigidly connected to the first end of the rocker arm, and the first end of the second hip stay is substantially rigidly connected to the second end of the rocker arm.

17. The suspension system of claim 12, further comprising a shoulder harness associated with the backpack.

18. A backpack comprising:

a pack bag for carrying a load;

a mounting plate associated with a portion of the pack bag;

a rocker arm pivotally connected to the mounting plate at a fixed pivot point, the rocker arm having a first end and a second end;

a first hip stay connected to the first end of the rocker arm;

a second hip stay connected to the second end of the rocker arm; and a waist belt attached to the first hip stay at a first point and to the second hip stay at a second point;

wherein the first and second hip stays are each independently connected to the rocker arm;

wherein a first end of the first hip stay is flexibly connected to the first end of the rocker arm, and a first end of the second hip stay is flexibly connected to the second end of the rocker arm;

wherein the load is transferred to the waist belt through at least the first and second hip stays; and wherein the waist belt is slidably movable with respect to the hip stays.

19. The backpack of claim 18, wherein the first and second hip stays allow the waist belt to pivot with respect to the mounting plate.

20. The backpack of claim 18, wherein the first and second hip stays distribute the load between a wearer's left hip and a wearer's right hip.

21. The backpack of claim 18, wherein the first and second hip stays equally distribute the load between the wearer's left hip and the wearer's right hip.

22. The backpack of claim 18, further comprising a shoulder harness.

23. A backpack comprising:

a pack bag for carrying a load;

a shoulder harness associated with an upper portion of the pack bag;

a first hip stay having a first end connected to the pack bag and a second end opposite the first end;

a second hip stay having a first end connected to the pack bag and a second end opposite the first end; and a waist belt movably associated with the second end of the first hip stay and the second end of the second hip stay and spaced a vertical distance from the shoulder harness, wherein the waist belt is movable with respect to the first and second hip stays such that the vertical distance between the shoulder harness and the waist belt varies to compensate for effective shortening or lengthening of a wearer's spine during bending movements;

wherein the first and second hip stays are independently coupled to a fixed pivot point and movable with respect thereto;

wherein the waist belt is moveably associated with the second end of the first hip stay and the second end of the second hip stay; and wherein the waist belt defines a first pocket for receiving the second end of the first hip stay and a second pocket for receiving the second end of the second hip stay.

24. A backpack comprising:

a pack bag for carrying a load;

a shoulder harness;

a waist belt;

a suspension system coupled to the waist belt, the suspension system comprising a pivot point for governing movement of the waist belt with respect to the pack bag and a hip stay member flexibly coupled to the pivot point and slidably associated with the waist belt, with the hip stay member movable in part along a fixed rotational path governed by the pivot point and further separately movable about a resilient portion disposed proximate an end of the hip stay member that is closest to the pivot point.

25. The backpack of claim 24, wherein the member comprises a curved portion.

26. The backpack of claim 25, wherein the curved portion is oriented generally toward a region of the waist belt configured to be disposed adjacent a wearer's hip.

27. The backpack of claim 24, further comprising a back pad, wherein vertical distance of the back pad with respect to the waist belt is adjustable.

28. The backpack of claim 24, wherein the position of the shoulder harness is vertically adjustable.

29. The backpack of claim 24, wherein the waist belt comprises a pocket for receiving the member.

30. The backpack of claim 29, wherein the pocket is open.

31. A backpack comprising:

a pack bag for carrying a load;

a shoulder harness;

a mounting plate;

a waist belt; and a suspension system coupled to the mounting plate and comprising a pivot point for movement of the waist belt with respect to the mounting plate and a movable hip stay member slidably associated with the mounting plate and waist belt;

wherein the suspension system in part defines a fixed rotational path spaced from the pivot point and along which an end of the hip stay member may move; and wherein the hip stay member comprises a flexible portion for also permitting movement of the hip stay member along a second path.

32. The backpack of claim 31, wherein the member comprises a curved portion.

33. The backpack of claim 32, wherein the curved portion is oriented generally toward a region of the waist belt configured to be disposed adjacent a wearer's hip.

34. The backpack of claim 31, further comprising a back pad, wherein vertical distance of the back pad with respect to the waist belt is adjustable.

35. The backpack of claim 31, wherein the shoulder harness is vertically adjustable in position.

36. The backpack of claim 31, wherein the waist belt comprises a pocket for receiving the member.

37. The backpack of claim 36, wherein the pocket is open.

* * * * *